US007993104B1

(12) United States Patent
Ewing, Jr.

(10) Patent No.: US 7,993,104 B1
(45) Date of Patent: Aug. 9, 2011

(54) TURBINE BLADE WITH SPAR AND SHELL

(75) Inventor: Joseph H. Ewing, Jr., Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 890 days.

(21) Appl. No.: 12/004,947

(22) Filed: Dec. 21, 2007

(51) Int. Cl.
*F01D 5/14* (2006.01)

(52) U.S. Cl. ..... 416/226; 416/241 R

(58) Field of Classification Search ..... 416/226, 416/236 R, 241 B, 214 R
See application file for complete search history.

(56) References Cited

U.S. PATENT DOCUMENTS

| | | | |
|---|---|---|---|
| 4,473,336 | A | 9/1984 | Coney et al. |
| 4,519,745 | A | 5/1985 | Rosman et al. |
| 4,790,721 | A | 12/1988 | Morris et al. |
| 7,080,971 | B2 | 7/2006 | Wilson et al. |

FOREIGN PATENT DOCUMENTS

| | | | |
|---|---|---|---|
| DE | 35 12 008 | A1 | 10/1986 |

*Primary Examiner* — Edward Look
*Assistant Examiner* — Dwayne J White
(74) *Attorney, Agent, or Firm* — John Ryznic

(57) ABSTRACT

A turbine blade assembly with a spar and shell construction. The shell is held in place between a tip edge of the spar and an airfoil shaped groove on the platform surface. A segmented seal assembly is held within the groove between the shell bottom surface. The segmented seal has a top face slanted inward toward the spar to engage with a similar slanted surface formed on the bottom face of the shell. The seal segments fit within the groove to engage both side walls to form a tight seal interface between the shell bottom surface and the outer wall of the groove. The seal segments are forced upward against the slanted underside of the shell due to centrifugal forces from rotation. A cooling air passage to supply pressurized cooling air to the groove and the underside surface of the seal segments also can be used to force the seal segments up against the slanted underside of the shell. Forcing the seal segments up against the slanted shell underside also forces the seal segments outward from the spar to enhance the sealing interface with the wall groove to further enhance the sealing affect.

6 Claims, 1 Drawing Sheet

View A-A

TURBINE BLADE WITH SPAR AND SHELL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with a spar and shell construction.

2. Description of the Related Art Including Information Disclosed Under 37 CFR 1.97 and 1.98

A gas turbine engine is a very efficient machine to convert a high temperature gas flow into mechanical energy. An industrial gas turbine engine, fuel efficiency and performance are very high priorities. Also, long running times are very important since these engines typically run for 48,000 hours before shutdown. Thus, part life is also critical.

Higher engine efficiencies can be obtained by passing a higher temperature gas into the turbine inlet. However, the maximum temperature at turbine inlet is related to the material capabilities of the first stage airfoils which include the stator guide vanes or nozzles and the rotor blades.

Rotor blades and stator vanes can be made from a spar and shell construction in order to allow for exposure to higher gas flow temperatures because of the use of exotic high temperature metals. U.S. Pat. No. 7,080,971 issued to Wilson et al on Jul. 25, 2006 and entitled COOLED TURBINE SPAR AND SHELL BLADE CONSTRUCTION (incorporated herein by reference) shows this type of blade. A shell made from a very high temperature material (such as ODS, CMC and Molybdenum) can withstand higher temperatures than the present day nickel alloys. However, these high temperature materials cannot be cast or machined. A special process is required to form the shell such as wire EDM. Therefore, a turbine blade made from the spar and shell construction can be used to increase the allowable turbine inlet temperature in order to further increase the efficiency of the engine.

In the above described Wilson et al patent (U.S. Pat. No. 7,080,971) the shell is held in place between the underside of the spar tip edge and the root in the platform of the blade assembly. The tip portion of the shell will form a tight and effective butt seal against the retaining head on the underside of the spar tip edge due to centrifugal loading. However, the bottom end of the shell slides within a groove formed on a top surface of the platform. Hot gas ingestion can occur through this interface and into the interior of the spar and shell construction.

BRIEF SUMMARY OF THE INVENTION

It is therefore an object of the present invention to provide for a turbine blade with a spar and shell construction with a seal formed between the lower end of the shell and the root or platform section of the blade assembly.

It is another object of the present invention to provide for a spar and shell turbine blade with a shell to root interface seal that will increase the sealing affect due to centrifugal forces acting on the seal.

It is another object of the present invention to provide for a spar and shell turbine blade with a shell to root interface seal that does not rely on any spring force to seat the seal.

It is another object of the present invention to provide for a spar and shell turbine blade with a shell to root interface seal that will allow relative thermal growth of the shell.

It is another object of the present invention to provide for a spar and shell turbine blade with a shell to root interface seal that will provide a level of support and a level of damping to the blade assembly.

It is another object of the present invention to provide for a spar and shell turbine blade with a shell to root interface seal that can take a fair amount of wear and still function.

DETAILED DESCRIPTION OF THE INVENTION

Figure 2:
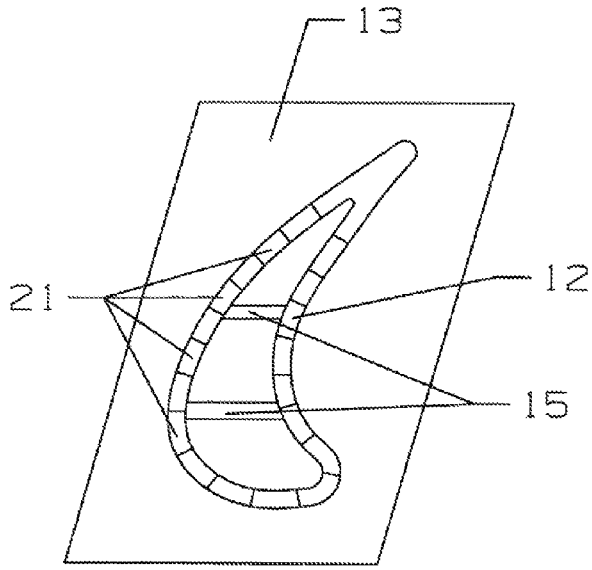
FIG. 2 shows a top cross section view of the root or platform section of the present invention.

The present invention is a turbine rotor blade with a spar and shell construction in which a shell is held in place between a tip of the spar that extends out form the root and platform section and the root section itself. The specific details of the spar and shell are described in the Wilson et al patent (U.S. Pat. No. 7,080,971 B2) described above and incorporated herein by reference. The root section 11 includes a groove 12 formed on the top face of the platform 13 in which the shell 14 is inserted. The shell 14, and therefore the groove 12, has an airfoil shape with the leading and trailing edges and the pressure side and suction side walls. FIG. 2 shows a top view of the platform 13 with the groove shown having this shape. The root 11 includes a fir tree configuration for securing the blade assembly 10 within a slot formed within a rotor disk. However, other slot engagement shapes can be used on the root section.

The spar 15 extends out from the root 11 and includes a top edge in which the shell abuts to secure the shell 14 between the spar tip edge and the platform groove 18. The spar 15 is secured to the root 11 by a screw, a bolt or a pin as shown in the Wilson et al patent. The spar 15 also includes a cooling supply channel to connect an outside source of pressurized cooling air to the cooling circuit contained within the spar. Impingement cooling holes are also formed within the spar to discharge cooling air against the inner surface of the shell 14 to provide impingement cooling.

Figure 1:
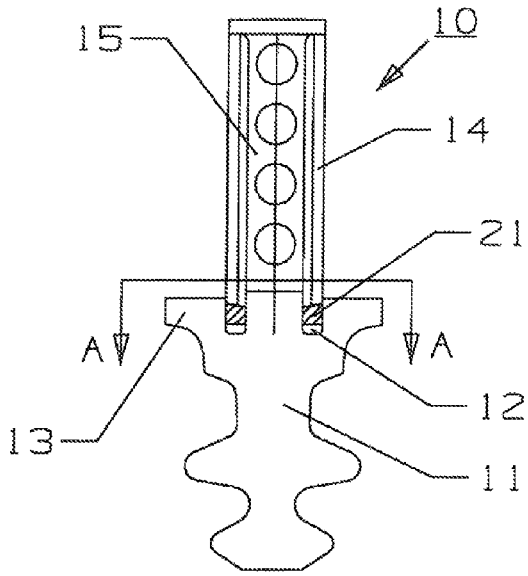
FIG. 1 shows a front cross section view of the turbine blade of the present invention.

A number of segmented root seals 21 are placed within the groove 12 between the bottom end of the shell and the groove 18 to provide a seal between the shell and the root 11. The seal is formed of a plurality of segments in order to relieve differential thermal growth between the seal and the platform. A single piece seal secured within the close tolerance groove 12 would be susceptible to binding and warping. The segmented seal 21 could be formed from as little as two segments to as many as shown in FIG. 2. If two segments are used, the first segment could extend from the leading edge to the trailing edge around the pressure side of the airfoil while the second segment would extend around the suction side. The segmented seal 21 includes a top surface having a slope that slants inward toward the spar 15 as seen in FIG. 1. The bottom surface of the shell 14 is also slanted to match the top surface of the segmented seal 21. The slanted interface between the seal top and the shell bottom will provide a further outward force on the seal to enforce contact with the groove wall and enhance the sealing effect. As the seal segments are pressed up against the bottom face of the shell, the seal segments will be forced outward and against the outer side wall of the airfoil shaped groove to enhance the seal interface. The seal segments are made from a high temperature resistant material that would operate under the temperatures on which the root 11 is exposed.

Figure 3:
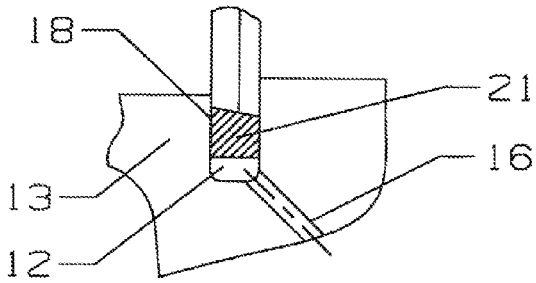
FIG. 3 shows a detailed view of the groove and seal of FIG. 1 with a cooling air supply hole opening into the groove.

A cooling air passage 16 is also formed within the root 11 to direct some cooling air from the supply channel to the underside surface of the segmented seal and provide additional sealing pressure as seen in FIG. 3. Pressurized cooling air will produce an upward force on the segmented seal 21 and push the seal 21 against the underside surface of the shell. Due to the slanted seal interface, the pressure force will also act to force the seal segments 21 against the outer wall surface 18 of the groove 12 and therefore further enhance the sealing affect.

As the rotor blade assembly operates in the engine, the rotation will produce a centrifugal force on the seal segments to force the seal up against the underside of the shell. Thus, the seal interface is enhanced to provide a better seal between the platform 13 and the shell 14. Also, the pressurized cooling air directed against the underside surface of the segmented seal 21 will also force the seal interface to increase is force and further enhance the seal affect. The slanted interface between the seal 21 and the shell 14 underside surface will force the seal segments outward away from the spar and up against the outer wall surface of the groove to enhance the seal interface between these two surfaces.

Numerous advantages of the segmented seal assembly used in the spar and shell blade construction are produced. The segmented seal is not a sheet metal seal. The segmented seal will not be delicate like sheet metal seals which are prone to warping, fatigue and wear. It does not rely on any spring force as in many sheet metal seals. Such spring forces will relax out in the turbine environment. The segmented seal will allow for relative thermal growth of the shell. Differential thermal growth of the shell with respect to the attachment root is accomplished by slippage. For circumferential and axial growth, slippage is between the seal and the shell. For radial growth, slippage is between the seal and the root groove. All the while, sealing is maintained. The segmented seal provides some level of support, thru friction, at the base of the shell. This will be beneficial for vibration purposes. High levels of support provide for high levels of damping. The segmented seal will provide a level of damping. Many if not all of the vibratory modes of the shell will involve movement at the root of the shell in one direction of the translational degrees of freedom. This movement will produce relative motion and friction damping. Any up and down (radial) motion of the shell will cause up and down motion of the seal which will be friction loaded against the side of the groove and will produce friction damping. Also, the segmented seal can take a fair amount of wear and still function, therefore increasing the service life of the blade assembly.

In the first embodiment of the present invention, the root section 11 of the blade assembly that includes the platform 13 is formed of a single piece as disclosed in the Wilson et al patent. However, the root section can be formed from two halves of substantially symmetric shape and joined together by a bolt or a screw or a pin, or the blade assembly secured between the halves by placement of the assembly within the slot of the rotor disk.

I claim:

1. A turbine blade for use in a gas turbine engine, the blade comprising:

a root portion having a platform with an airfoil shaped groove on the top face;

a spar extending from the root portion and having a tip edge;

a shell secured to the turbine blade between the tip edge of the spar and the airfoil shaped groove; and, a segmented seal assembly on each side of the airfoil and formed from a plurality of separate seal segments held between the airfoil shaped groove and the shell, the segmented seal assembly forming a seal between the groove and the shell.

2. The turbine blade of claim 1, and further comprising:

the segmented seal assembly having at least two segments with one segment located on the pressure side of the platform and the other segment located on the suction side of the platform.

3. The turbine blade of claim 1, and further comprising:

the seal segments have a width substantially equal to the width of the airfoil shaped groove such that the seal segments can be forced upward due to centrifugal forces during rotation of the blade while maintaining a seal between the airfoil shaped groove.

4. The turbine blade of claim 1, and further comprising:

the seal segments each include a side surface that rubs against a side surface of the groove to produce damping for the shell.

5. A turbine blade for use in a gas turbine engine, the blade comprising:

a root portion having a platform with an airfoil shaped groove on the top face;

a spar extending from the root portion and having a tip edge;

a shell secured to the turbine blade between the tip edge of the spar and the airfoil shaped groove;

a segmented seal assembly held between the airfoil shaped groove and the shell, the segmented seal assembly forming a seal between the groove and the shell;

the seal segments include a top face slanted toward the spar; and, the underside surface of the shell having a similar shaped slanted surface such that an upward force applied to the seal segments will force the seal segments outward from the spar.

6. A turbine blade for use in a gas turbine engine, the blade comprising:

a root portion having a platform with an airfoil shaped groove on the top face;

a spar extending from the root portion and having a tip edge;

a shell secured to the turbine blade between the tip edge of the spar and the airfoil shaped groove;

a segmented seal assembly held between the airfoil shaped groove and the shell, the segmented seal assembly forming a seal between the groove and the shell; and, the airfoil shaped groove includes a pressurized cooling air passage to supply pressurized cooling air to the underside surface of the seal segments and force the seal segments up against the shell.

* * * * *